US006923690B1

(12) United States Patent
Wang

(10) Patent No.: US 6,923,690 B1
(45) Date of Patent: Aug. 2, 2005

(54) SPRING-LOADED ELECTRICAL CONTACT

(75) Inventor: Eric Wang, Taipei Hsien (TW)

(73) Assignee: Advanced Connection Technology Inc., (TW)

( * ) Notice: Subject to any disclaimer, the term of this patent is extended or adjusted under 35 U.S.C. 154(b) by 0 days.

(21) Appl. No.: 10/893,406

(22) Filed: Jul. 16, 2004

(30) Foreign Application Priority Data

Apr. 16, 2004 (TW) ..... 93110916 A

(51) Int. Cl.[7] ..... H01R 13/24
(52) U.S. Cl. ..... 439/824; 439/500
(58) Field of Search ..... 439/824, 700, 439/500, 627, 482

(56) References Cited

U.S. PATENT DOCUMENTS 3,171,183 A * 3/1965 Johnston ..... 24/635
4,636,026 A * 1/1987 Cooney et al. ..... 439/482
4,904,213 A * 2/1990 Hock et al. ..... 439/824
5,509,813 A * 4/1996 Lu ..... 439/79
6,340,320 B1 * 1/2002 Ogawa ..... 439/824

* cited by examiner

*Primary Examiner*—Hien Vu
(74) *Attorney, Agent, or Firm*—DLA Piper Rudnick Gray Cary US LLP

(57) ABSTRACT

A spring-loaded electrical contact includes a conductive terminal disposed movably in a receiving space that is confined by a U-shaped base part of a conductive mounting seat. The conductive terminal is operable to move from a released state, where a first end portion of the conductive terminal is spaced apart from an intermediate plate portion of the base part, to a pressed state, where the first end portion of the conductive terminal is proximate to the intermediate plate portion of the base part and where an intermediate stop portion of the conductive terminal is clamped between two clamping pieces formed respectively on two lateral plate portions of the base part. A biasing member is disposed in the receiving space and is mounted between the intermediate stop portion and the intermediate plate portion for biasing the conductive terminal to the released state.

2 Claims, 4 Drawing Sheets

SPRING-LOADED ELECTRICAL CONTACT

CROSS-REFERENCE TO RELATED APPLICATION

This application claims priority of Taiwanese Application No. 093110916, filed on Apr. 16, 2004.

BACKGROUND OF THE INVENTION

1. Field of the Invention

The invention relates to an electrical contact, more particularly to a spring-loaded electrical contact that has a stable construction suitable for low-cost fabrication.

2. Description of the Related Art

Referring to FIGS. 1 to 3, a conventional spring-loaded electrical contact 1, such as a battery contact, is shown to include a housing 11, a conductive terminal 12 and a coiled spring 13.

The housing 11, which is made of metal, has a bottom wall 111 to be soldered onto a circuit board (not shown), and a surrounding wall 112 extending upwardly from a periphery of the bottom wall 111. The bottom wall 111 and the surrounding wall 112 confine a receiving space 113. The surrounding wall 112 has an upper end formed with an annular flange 1120 that defines an opening 114 for access into the receiving space 113.

The conductive terminal 12, which is made of metal, is disposed movably in the receiving space 113. The conductive terminal 12 has a first end portion 122 disposed in the receiving space 113, a second end portion 121 opposite to the first end portion 122 and extending outwardly of the housing 11 through the opening 114, and an intermediate stop portion 123 interconnecting the first and second end portions 122, 121, disposed in the receiving space 113, and in sliding contact with the surrounding wall 112. The conductive terminal 12 is operable so as to move from a released state, where the first end portion 122 of the conductive terminal 12 is spaced apart from the bottom wall 111 of the housing 11, as shown in FIG. 2, to a pressed state, where the first end portion 122 of the conductive terminal 12 is proximate to the bottom wall 111 of the housing 11, as shown in FIG. 3.

The coiled spring 113 is disposed in the receiving space 113, and is mounted between the intermediate stop portion 123 of the conductive terminal 12 and the bottom wall 111 of the housing 11 for biasing the conductive terminal 12 to the released state.

The following are some of the drawbacks of the conventional spring-loaded electrical contact 1:

1. Since the housing 11 and the conductive terminal 12 are required to be machined, fabrication of the conventional spring-loaded electrical contact 1 entails relatively high costs.

2. When the conductive terminal 12 is moved from the pressed state to the released state by the action of the coiled spring 13, the intermediate stop portion 123 bumps against the annular flange 1120, which can lead to wearing of the intermediate stop portion 123 such that stable conduction cannot be ensured.

SUMMARY OF THE INVENTION

Therefore, the object of the present invention is to provide a spring-loaded electrical contact that can overcome the aforesaid drawbacks of the prior art.

According to the present invention, a spring-loaded electrical contact comprises:

a conductive mounting seat having a U-shaped base part that includes opposite lateral plate portions, and an intermediate plate portion interconnecting the lateral plate portions and cooperating with the lateral plate portions to confine a receiving space, the mounting seat further having a solder tab extending from the intermediate plate portion, each of the lateral plate portions being formed with a resilient clamping piece that projects into the receiving space toward the other one of the lateral plate portions;

a conductive terminal disposed movably in the receiving space, the conductive terminal having opposite first and second end portions, and an intermediate stop portion interconnecting the first and second end portions, the conductive terminal being operable so as to move from a released state, where the first end portion of the conductive terminal is spaced apart from the intermediate plate portion of the base part of the conductive mounting seat, to a pressed state, where the first end portion of the conductive terminal is proximate to the intermediate plate portion of the base part of the conductive mounting seat and where the intermediate stop portion is clamped between the clamping pieces on the lateral plate portions of the base part of the mounting seat; and a biasing member disposed in the receiving space and mounted between the intermediate stop portion of the conductive terminal and the intermediate plate portion of the base part of the mounting seat for biasing the conductive terminal to the released state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
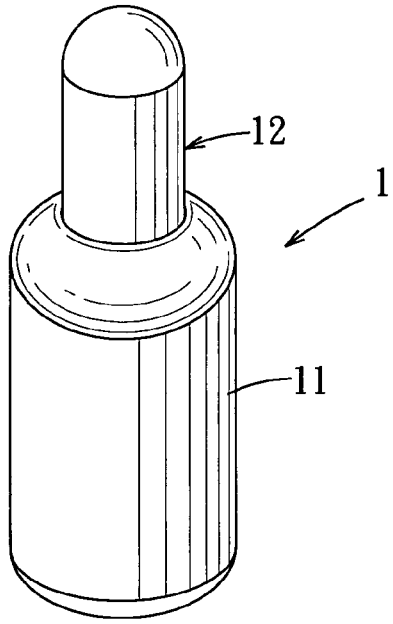
FIG. 1 PRIOR ART
FIG. 1 is a perspective view of a conventional spring-loaded electrical contact.
Figure 2:
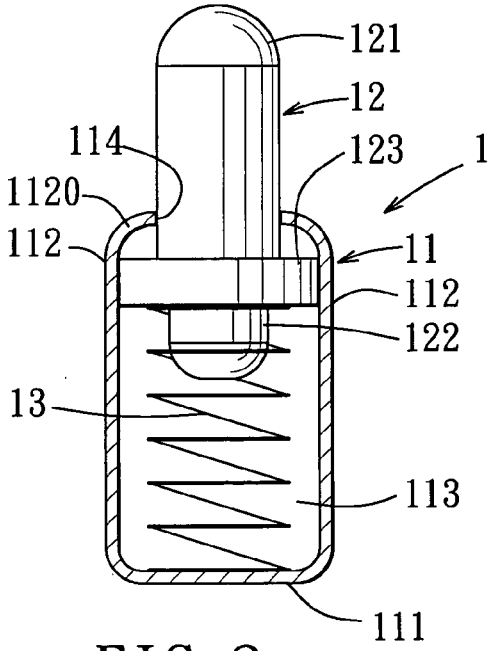
FIG. 2 PRIOR ART
FIG. 2 is a partly sectional schematic view showing the conventional spring-loaded electrical contact when a conductive terminal thereof is in a released state.
Figure 3:
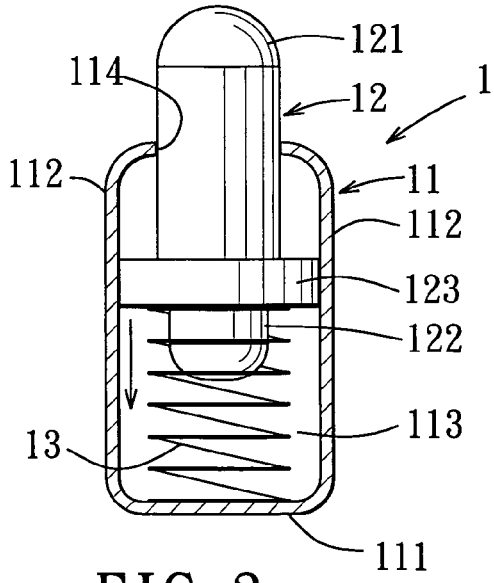
FIG. 3 PRIOR ART
FIG. 3 is a partly sectional schematic view showing the conventional spring-loaded electrical contact when the conductive terminal is in a pressed state.
Figure 4:
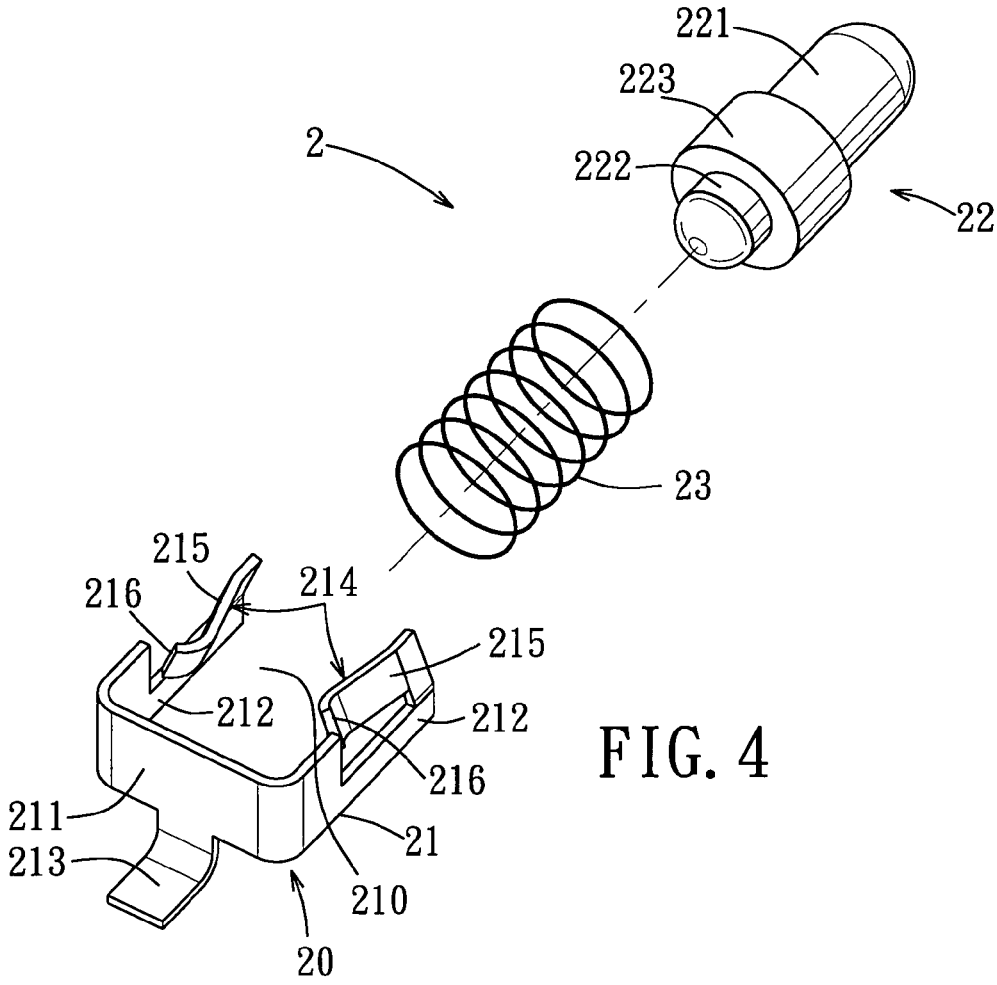
FIG. 4 is an exploded perspective view showing the preferred embodiment of a spring-loaded electrical contact according to the present invention.
Figure 5:
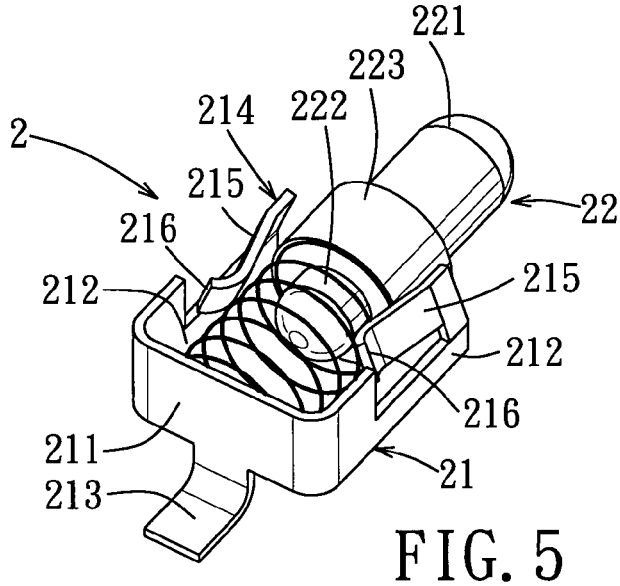
FIG. 5 is a perspective view showing the preferred embodiment after assembly.

Referring to FIGS. 4 and 5, the preferred embodiment of a spring-loaded electrical contact 2 according to the present invention is shown to include a unitary conductive mounting seat 20 formed by punching, a conductive terminal 22, and a biasing member 23.

The mounting seat 20, which is made of metal, has a U-shaped base part 21 that includes opposite lateral plate portions 212, and an intermediate plate portion 211 interconnecting the lateral plate portions 212 and cooperating with the lateral plate portions 212 to confine a receiving space 210. The mounting seat 20 further has a solder tab 213 extending from the intermediate plate portion 211. Each of the lateral plate portions 212 is formed with a resilient clamping 214 that projects into the receiving space 210 toward the other one of the lateral plate portions 212. In this embodiment, each of the clamping pieces 214 has a coupling end 215 connected to a corresponding one of the lateral plate portions 212, and a free end 216 opposite to the coupling end 215.

The conductive terminal 22, which is made of metal, is disposed movably in the receiving space 210. The conductive terminal 22 has opposite first and second end portions 222, 221, and an intermediate stop portion 223 interconnecting the first and second end portions 222, 221. The conductive terminal 22 is operable so as to move from a released state, where the first end portion 222 of the conductive terminal 22 is spaced apart from the intermediate plate portion 211 of the base part 21 of the conductive mounting seat 20, as shown in FIG. 6, to a pressed state, where the first end portion 222 of the conductive terminal 22 is proximate to the intermediate plate portion 211 of the base part 21 of the conductive mounting seat 20 and where the intermediate stop portion 223 is clamped between the clamping pieces 214 on the lateral plate portions 212 of the base part 21 of the conductive mounting seat 20, as shown in FIG. 7.

The biasing member 23 is disposed in the receiving space 210, and is mounted between the intermediate stop portion 223 of the conductive terminal 22 and the intermediate plate portion 211 of the base part 21 of the conductive mounting seat 20 for biasing the conductive terminal 22 to the released state. In this embodiment, the biasing member 23 is a coiled spring.

Figure 6:
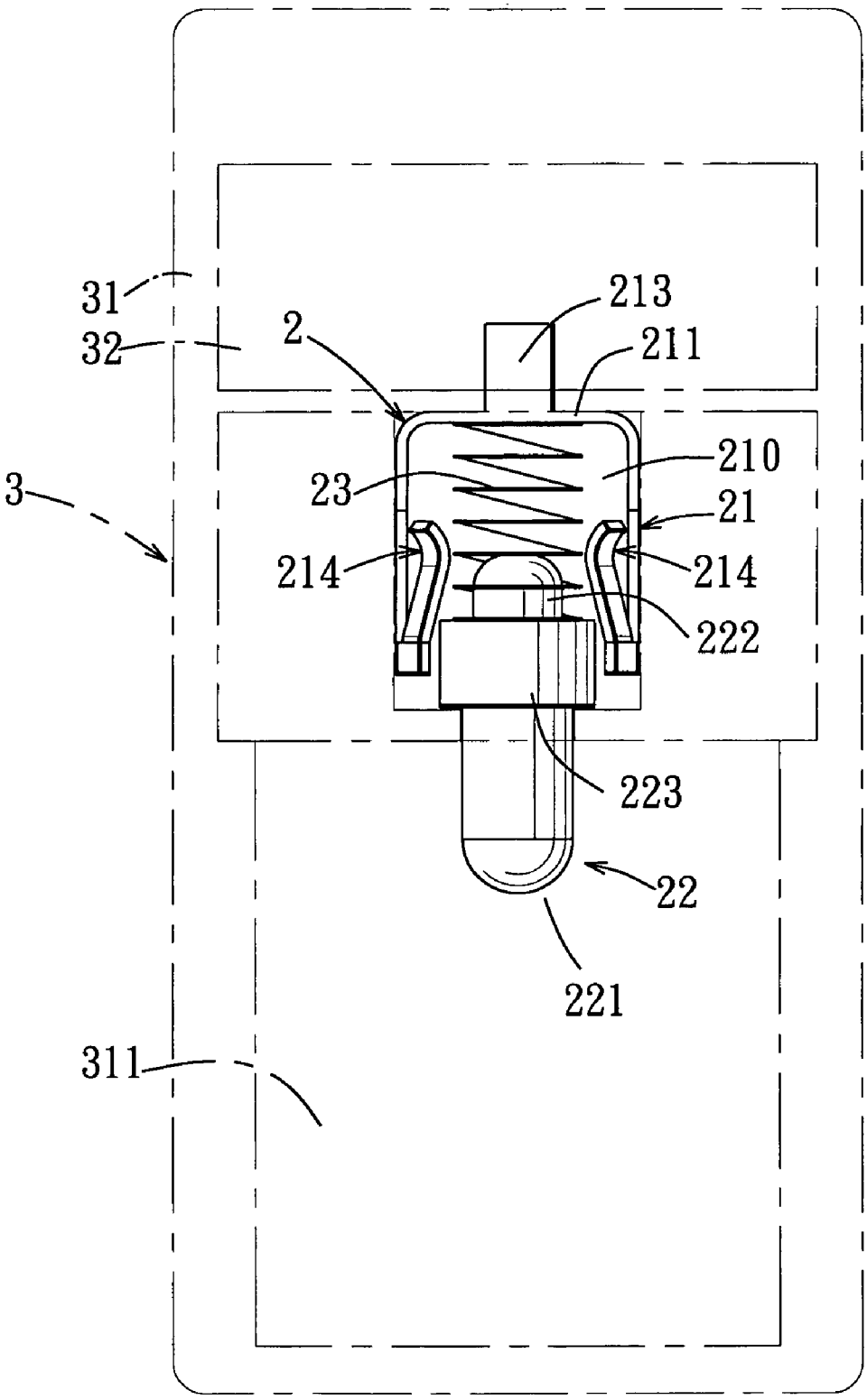
FIG. 6 is a schematic view showing the preferred embodiment when mounted in an electronic device and when a conductive terminal of the preferred embodiment is in a released state.
Figure 7:
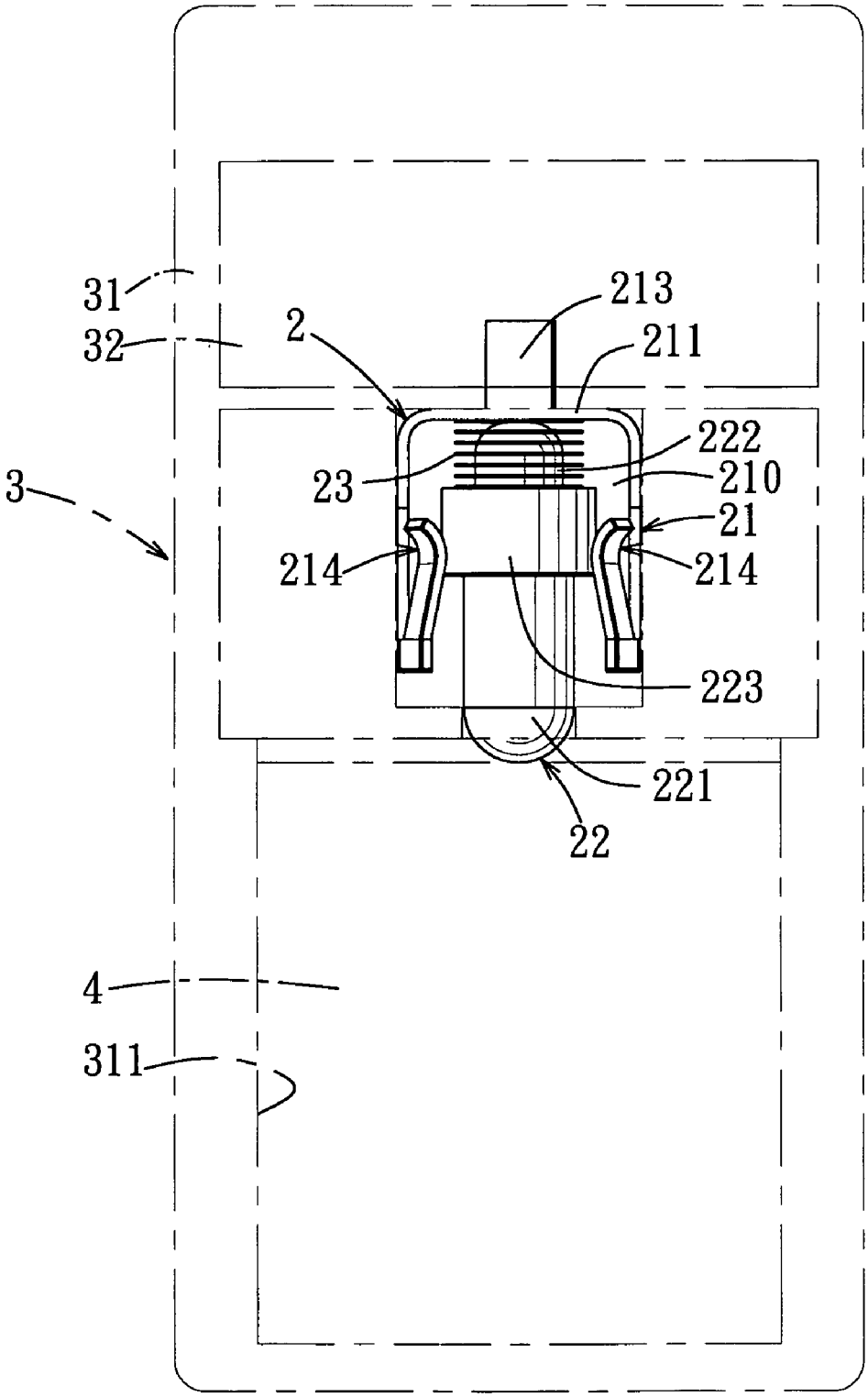
FIG. 7 is a schematic view similar to FIG. 6 but showing the conductive terminal in a pressed state.

In actual use, referring to FIGS. 6 and 7, the spring-loaded electrical contact 2 of this invention can be installed in an electronic device 3, such as a mobile phone, a personal digital assistant, etc., that includes a housing 31 confining a battery-receiving space 311 for receiving a battery 4, and a circuit board 32 mounted in the housing 31. The solder tab 213 of the mounting seat 2 is adapted to be soldered onto the circuit board 32. As such, when the battery 4 is not received in the battery-receiving space 311, the conductive terminal 22 is in the released state, and the second end portion 221 of the conductive terminal 22 extends into the battery-receiving space 311, as shown in FIG. 6. When the battery 4 is received in the battery-receiving space 311, the second end portion 221 of the conductive terminal 22 is adapted to contact electrically the battery 4 and is urged by the battery 4 so as to move from the released state to the pressed state, as shown in FIG. 7, such that electric power from the battery 4 is supplied to the circuit board 32 via the spring-loaded electrical contact 2 of this invention.

It is noted that, in the electrical contacts 2 of this invention, only the conductive terminal 22 needs to be machined, thereby resulting in lower fabrication costs. Furthermore, due to the presence of the clamping pieces 214, the intermediate stop portion 223 can be stably positioned so as to minimize wear thereof such that stable conduction can be ensured.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A spring-loaded electrical contact comprising:

a conductive mounting seat having a U-shaped base part that includes opposite lateral plate portions, and an intermediate plate portion interconnecting said lateral plate portions and cooperating with said lateral plate portions to confine a receiving space, said mounting seat further having a solder tab extending from said intermediate plate portion, each of said lateral plate portions being formed with a resilient clamping piece that projects into said receiving space toward the other one of said lateral plate portions;

a conductive terminal disposed movably in said receiving space, said conductive terminal having opposite first and second end portions, and an intermediate stop portion interconnecting said first and second end portions, said conductive terminal being operable so as to move from a released state, where said first end portion of said conductive terminal is spaced apart from said intermediate plate portion of said base part of said mounting seat, to a pressed state, where said first end portion of said conductive terminal is proximate to said intermediate plate portion of said base part of said mounting seat and where said intermediate stop portion is clamped between said clamping pieces on said lateral plate portions of said base part of said mounting seat; and a biasing member disposed in said receiving space and mounted between said intermediate stop portion of said conductive terminal and said intermediate plate portion of said base part of said mounting seat for biasing said conductive terminal to the released state;

wherein each of said clamping pieces has a coupling end adjacent to said intermediate stop portion and connected to a corresponding one of said lateral plate portions, and a free end opposite to said coupling end being extended toward said intermediate plate portion.

2. The spring-loaded electrical contact as claimed in claim 1, wherein said biasing member is a coiled spring.

* * * * *